US005797334A

United States Patent [19]

Weitzel

[11] Patent Number: 5,797,334

[45] Date of Patent: Aug. 25, 1998

[54] FLUIDIZED BED BOILER WITH BED DRAIN ASH COOLING AND TRANSFER

[75] Inventor: Paul S. Weitzel, Canal Fulton, Ohio

[73] Assignee: The Babcock & Wilcox Company, New Orleans, La.

[21] Appl. No.: 799,724

[22] Filed: Feb. 12, 1997

[51] Int. Cl.[6] ..... F23G 5/00; F23G 7/00

[52] U.S. Cl. ..... 110/245; 122/4 D

[58] Field of Search ..... 122/4 D; 110/245

[56] References Cited

U.S. PATENT DOCUMENTS

| | | | |
|---|---|---|---|
| 4,263,877 | 4/1981 | Urquhart | 110/245 |
| 4,434,726 | 3/1984 | Jones | 110/245 |
| 4,790,251 | 12/1988 | Vidt | 110/165 R |
| 4,860,694 | 8/1989 | Walker | 122/4 D |
| 4,872,423 | 10/1989 | Pillai | 122/4 D |
| 4,901,652 | 2/1990 | Pressnall et al. | 110/259 |
| 4,909,163 | 3/1990 | Hjalmarsson | 110/266 |
| 5,022,330 | 6/1991 | Burgher et al. | 110/235 |
| 5,093,085 | 3/1992 | Engstrom et al. | 110/245 |
| 5,095,854 | 3/1992 | Dietz | 122/4 D |
| 5,146,856 | 9/1992 | George | 111/171 |
| 5,163,374 | 11/1992 | Rehmat et al. | 110/342 |
| 5,176,089 | 1/1993 | Jonsson | 110/245 |
| 5,269,263 | 12/1993 | Garcia-Mallol | 122/4 D |
| 5,309,848 | 5/1994 | Santelmann et al. | 110/171 |
| 5,443,022 | 8/1995 | Winkin et al. | 110/245 |

OTHER PUBLICATIONS

Hanway et al., "Discharge and Handling of Solids from Pressurized Fluidized-bed Combustors", report from Argonne National Laboratory, ANL/CEN/FE-81-3, 1982, entire paper.

*Primary Examiner*—Philip H. Leung
*Assistant Examiner*—Jiping Lu
*Attorney, Agent, or Firm*—Robert J. Edwards; Eric Marich

[57] ABSTRACT

A fluidized bed boiler bottom with an ash cooling and removal system has a water-cooled tube panel floor with fluidization bubble caps above a windbox, and a structural support and at least one hopper, each of the at least one hoppers with a bed ash cooler region and drain control system positioned beneath the tube panel floor. The hoppers are formed from cooled enclosure tubes and have sloped upper walls and lower troughs having vertical walls. Standpipes are provided through the tube panel floor down into the troughs at the bottoms of the hoppers. The standpipes may be arranged in an H-pattern in the tube panel floor and subsequently channel several flowpaths together into fewer standpipes closer to the troughs. Solids flow through the standpipes is controlled by operation of fluidizing nozzles located underneath the standpipes. Pulsing the flow of air through the fluidizing nozzles prevents or allows solids to flow through the standpipe from the bed. Some cooling air may flow up through the standpipes, cooling solids in the standpipes.

7 Claims, 4 Drawing Sheets

FLUIDIZED BED BOILER WITH BED DRAIN ASH COOLING AND TRANSFER

BACKGROUND OF THE INVENTION

1. Field of the Invention

The present invention relates generally to the field of fluidized bed boilers and in particular to an apparatus and method for cooled and controlled ash removal from the bottom of a fluidized bed through a bed drain.

2. Description of the Related Art

Existing methods used for the control of bed drain rate of solids flow include "L" valves, which are a type of non-mechanical valve, rotary "pocket" valves, screw conveyors, gravity overflow discharge pipes, standpipes with vibrating feeders, and pneumatic transport lift lines.

Bed ash cooling has been suggested or accomplished with immersed air sparger pipes, water cooling coils, water jacketed drain pipes, water cooled screw conveyors, external fluidized bed coolers, and water quench hoppers. In some instances, the boiler pressure seal is controlled by the above devices, or alternatively, with lockhopper tanks and valves.

Some of these ash cooling methods and apparatus for fluidized beds are disclosed in patents.

In particular, U.S. Pat. No. 5,176,089 discloses a slow moving fluidized bed with one or more levels of sparger air cooling ducts in combination with water/steam cooled tube coils and enclosure walls. The hopper insert is uncooled and the included angle must be small in order to ensure the free flow of solids. Thus, a taller hopper, or many small hoppers must be used to withdraw solids from the entire bed region. The sparge duct air injection system uses bubble caps to fluidize the combustion bed above the bottom. The sparge ducts are immersed in the hot packed solids. Large thermal transients occur due to start up with very hot air for fuel ignition and then, subsequently, injecting cooler air for normal operation. The thermal transients create cyclic thermal fatigue stresses that distort and crack the sparge ducts. The sparge duct devices operating in the high temperature ash require more frequent maintenance and replacement.

U.S. Pat. No. 5,095,854 teaches a fluidized bed reactor having drain pipes in a furnace section and in adjacent coolers for selectively removing particulate material from both the furnace section and the cooler. Particles in the fluidized bed are allowed to flow transversely between the furnace and the adjacent cooling sections. The particulate material contained within the furnace section may flow directly through one of a pair of drain standpipes for passing to one of two coolers of the type using screw conveyors, sparge air ducts, or other known ash cooling means before removal from the system.

Other patents relate different methods for conveying ash between a fluidized bed bottom and cooling systems.

U.S. Pat. No. 5,146,856 discloses a screw conveyor ash cooler located downstream of the combustion furnace to cool ash.

U.S. Pat. No. 5,163,374 discloses a similar cooling system utilizing a driven screw located beneath the combustion fluidized bed. The screw receives ash directly from the combustion fluidized bed and conveys it to a regenerator.

A transfer system for moving circulating fluidized bed recycle solids from a return leg back into the furnace which replaces an "L" valve is taught by U.S. Pat. No. 4,860,694.

U.S. Pat. No. 4,872,423 describes a system that includes a means for steam coil cooling of bed ash which includes sparge air ducts. The system treats bed ash by resizing with steam breakup and recycling to the combustion bed.

U.S. Pat. No. 4,909,163 is for a system which cools, filters, and recirculates gas in the boiler bottom for conditioning the ash for removal from the bed. Sparge ducts are included to provide combustion air and a rotary feeder is used to control the rate of solids removal.

A report from Argonne National Laboratory, ANL/CEN/FE-CASE 81-3, "DISCHARGE AND HANDLING OF SOLIDS FROM PRESSURIZED FLUIDIZED-BED COMBUSTORS" (1982), describes several known systems and associated problems with ash removal, cooling and sealing against the pressurized fluidized bed combustor high pressure boundary.

SUMMARY OF THE INVENTION

It is an object of the present invention to provide an ash cooling and removal system for a fluidized bed having a controlled rate of solids removal from regions of the bed.

It is a further object of the invention to provide a system which cools the ash from temperatures of about 860° C. (1580° F.) to manageable temperatures.

It is a further object to provide an ash cooling and removal system which reduces the maintenance and replacement down time required of the fluidized bed compared to known cooling systems.

Accordingly, a fluidized bed boiler bottom with an ash cooling and removal system is provided having a water-cooled tube panel floor with fluidization bubble caps above a windbox, and a structural support and two or more hoppers each with a bed ash cooler region and drain control system positioned beneath the tube panel floor. The hoppers are formed from cooled enclosure tubes and have sloped upper walls and lower troughs having vertical walls.

Standpipes are provided through the tube panel floor down into the troughs at the bottoms of the hoppers. The standpipes may be arranged in an H-pattern in the tube panel floor and subsequently channel several flowpaths together into fewer standpipes closer to the troughs.

Solids flow through the standpipes is controlled by operation of fluidizing nozzles located underneath the standpipes. Pulsing the flow of air through the fluidizing nozzles prevents or allows solids to flow through the standpipe from the bed. Further, some cooling air may flow up through the standpipes, cooling the solids within the standpipes.

Several hoppers and troughs are used to cool the bed drain ash, thereby concentrating the ash in a smaller cooling region and requiring less cooling air to control the ash flow and cool the ash by fluidization mixing in the trough region. Changing the rate of flow of the fluidization gas controls the speed of the removal rate and allows for over-fluidizing of larger particles.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
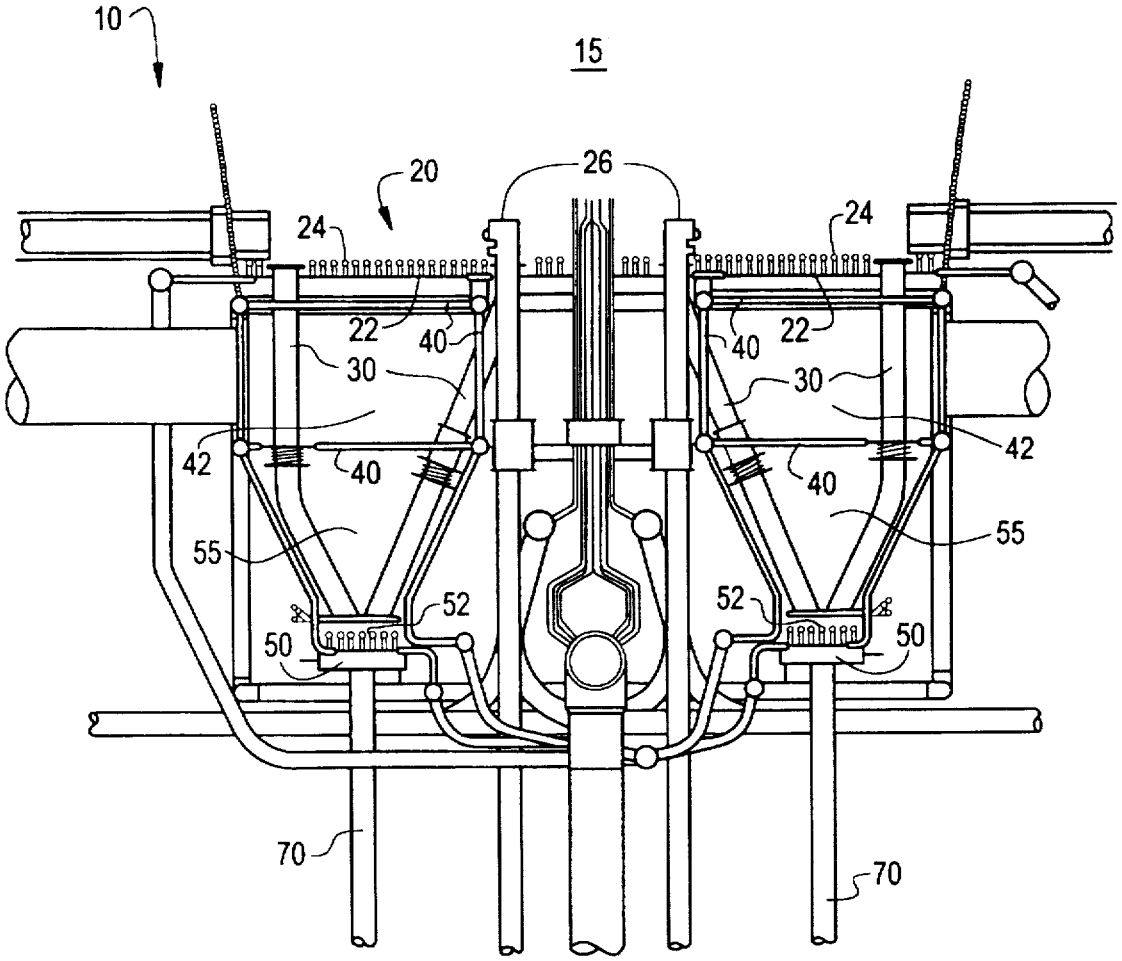
FIG. 1 is a partial sectional side elevational view of a boiler fluidized bed having the ash cooling and removal system of the invention.

Referring now to the drawings, in which like reference numerals have been used to designate the same or similar elements, FIG. 1 is a fluidized bed boiler 10 having a bed region 15 with boiler bottom 20. Boiler bottom 20 is constructed from water cooled tube panel floor 22 having a plurality of bubble caps 24 projecting above the upper surface of tube panel floor 22. Standpipes 30 protrude through tube panel floor 22 into the boiler bottom 20.

The standpipes 30 extend vertically down from the tube panel floor 22 into a hopper 55 below a windbox 42. The windbox 42 structure and hopper 55 may be supported by any known means, although one possible support structure uses water cooled braces 40 arranged below the boiler 10 structure.

Figure 4:
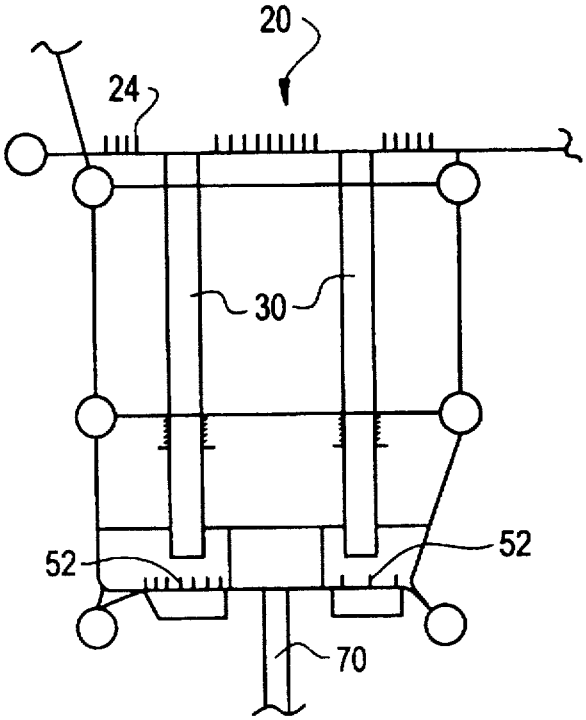
FIG. 4 is a partial sectional side elevational view of an alternate hopper and standpipe arrangement for use with the invention.

The standpipes 30 may be inclined slightly at their lower end to accommodate the shape of the hopper 55, as shown in FIG. 1, but the standpipes 30 may also be completely vertical within the hopper 55. This may be accomplished by moving the standpipes toward the center of the hopper 55, or alternatively by changing the shape of the hopper 55 to a straight-sided design. FIG. 4 shows a possible hopper 55 design of this type.

In either case, the standpipes 30 terminate above a cooling trough 50, having fluidizing bubble caps 52 near the bottom of the cooling trough 50 for regulating the flow of ash through the standpipes 30 and helping to cool the ash as well.

Figure 2:
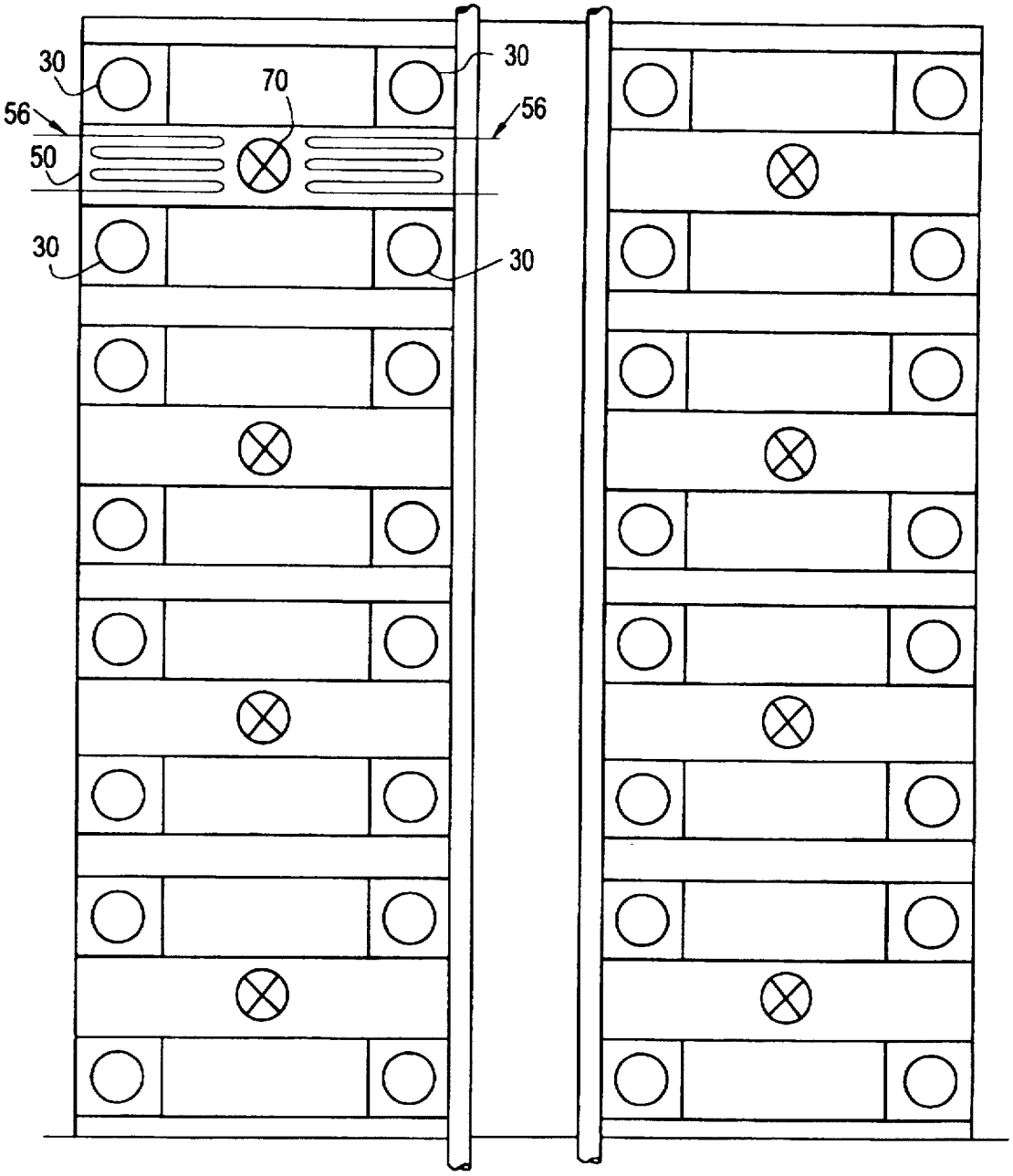
FIG. 2 is a sectional top plan view of an orientation of standpipes and drains for use with the invention.
Figure 3:
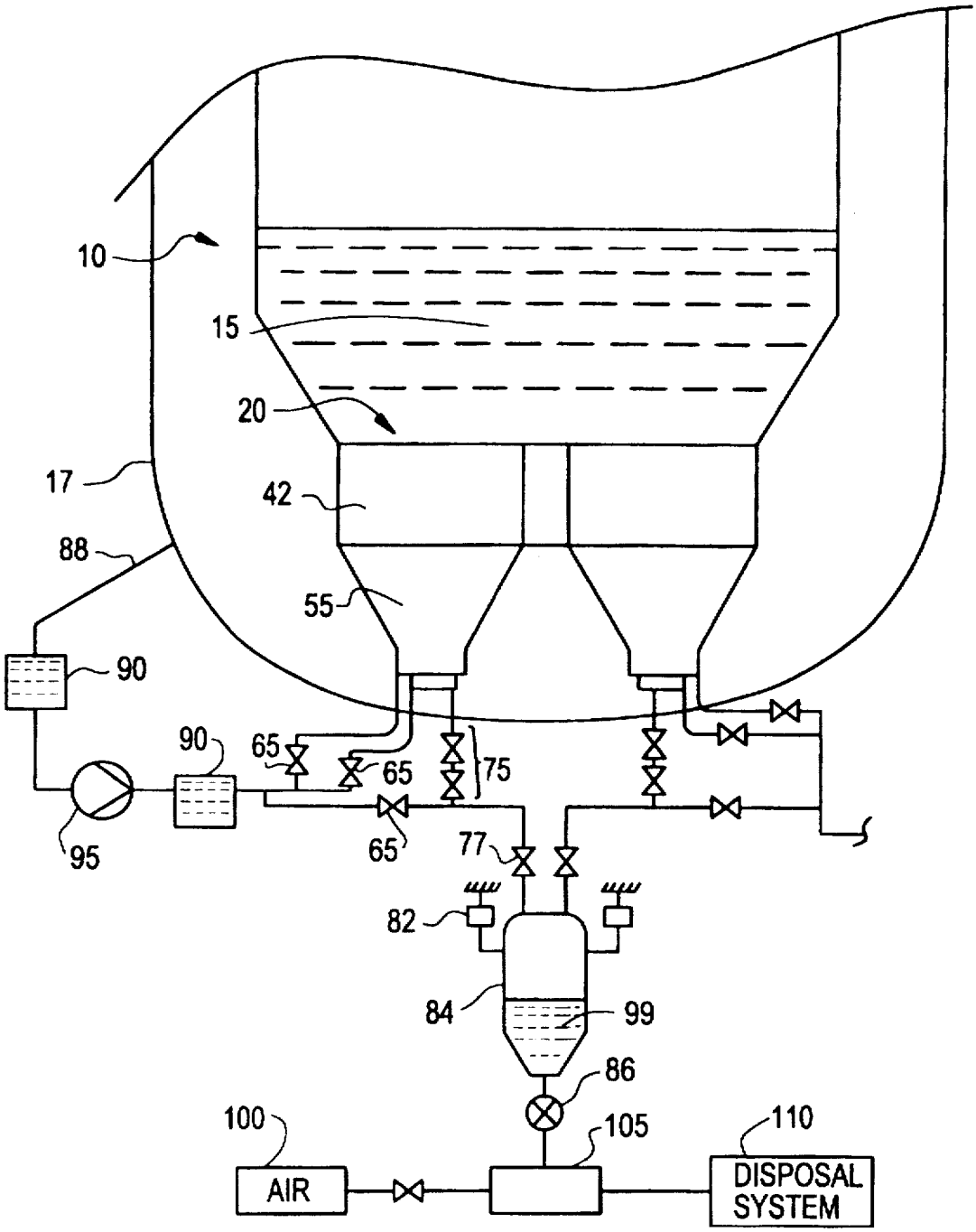
FIG. 3 is a schematic diagram of the boiler fluidized bed ash cooling and removal system.

Trough 50 has a drain 70 extending from the bottom downward through an "L" valve 75 (shown in FIG. 3). As seen in FIG. 2, one drain 70 may be used to remove bed ash from a hopper 55 having four standpipes 30 supplying ash from the boiler bottom 20. In this arrangement, the standpipes 30 are provided in a "H" pattern. It is envisioned that low temperature cooling coils 56 may be positioned between standpipes 30 to provide additional cooling by convection.

The fluidizing bubble caps 52 in the trough are positioned below the standpipes 30 to blow cooling air upward at the ash falling through the standpipes 30.

FIG. 3 shows how cooling air is provided to the cooling trough in the environment of a pressurized fluidized bed boiler. The boiler 10 is inside a pressure vessel 17, which is pressurized by an air supply (not shown). A supply tube 88 is used to withdraw some of the pressurized air from the pressure vessel 17 and provide the air to a pair of coolers 90 and a compressor 95 placed in series. The coolers 90 and compressor 95 reduce the temperature of the air, which is then provided to the fluidizing bubble caps 52 in the cooling trough 50 through a valve 65. The cooled air can also be provided adjacent the drain 70 through another valve 65 to fluidizing and/or directional nozzles to force ash toward the drain 70.

As further seen in FIG. 3, the drain 70 connects to a lockhopper tank 84 through L valve 75 and isolation valve 77. Lockhopper tank has load cells 82 near its upper end. Cooled ash 99 passes through the drain into the lockhopper 84, where it may be conveyed through a rotary valve 86 to a pickup region 105, where air 100 is used to transport the cooled ash 99 to a disposal system 110.

The ash removal and cooling system of the invention has several advantages over known systems. Combustion air may be injected through the bubble caps 24 into the fluidized bed 15, thereby providing an adequate pressure differential to achieve stable jet bubble solids mixing and allowing control for providing biased or even air distribution. The water cooled bubble cap 24 and tube panel floor 24 combined with the structural support system of the braces 40 provides an economic way to handle differential pressure and weight exerted by the fluidized bed mass. The water cooled supports and floors reduces the tendency of distortion and creep fatigue failures to occur.

The windbox 42 may be larger, allowing improved air distribution, and easier access during shutdowns for maintenance. Further the design prevents fluidized material from remaining near the fluidizing bubble cap 24 nozzles, thereby limiting the effect of back-shifted bed material.

The bed ash is cooled by a combination of the cooled fluidizing air provided in the cooling trough 50 and low temperature cooling tube coils 56 placed between standpipes 30. Nitrogen may also be injected into the trough 50 to prevent sintering of the cooled ash in the hopper 55.

The amount of ash removed from the fluidized bed 15 may be controlled by selectively sequencing the amount of cooled fluidizing air below each standpipe 30. The flow of ash may be promoted by providing more fluidizing cooled air beneath a standpipe 30. The ash in a hopper 55 may be allowed to cool for a longer period of time before being passed to the lockhopper 84 while other hoppers 55 are filled with ash. The lower ash temperatures attainable with this system allow lower cost materials to be used for the L valves 75, isolation valves 77, lockhopper 84 and ash removal elements 100, 105, 110.

While a specific embodiment of the invention has been shown and described in detail to illustrate the application of the principles of the invention, it will be understood that the invention may be embodied otherwise without departing from such principles.

What is claimed is:

1. An ash cooling and removal system for a fluidized bed boiler, the system comprising:

a boiler tube panel floor;

a boiler bed region above the boiler tube panel floor or containing a hot ash;

a plurality of bubble caps projecting above the boiler tube panel floor for providing a fluidizing air to the boiler bed region;

a windbox beneath the boiler tube panel floor;

a plurality of ash hoppers beneath the windbox, each ash hopper having a cooling trough at a lower end, for concentrating the ash into smaller cooling regions which require less cooling air to control ash flow and cooling of ash by fluidization mixing in the cooling trough;

a plurality of standpipes extending from above the boiler tube panel floor through the windbox and into the ash hoppers, each standpipe having a lower end positioned above the cooling trough, each standpipe for transporting hot ash from the boiler bed region to one of the ash hoppers;

fluidizing means at each cooling trough for providing cooling air to cool the ash by fluidization mixing and for controlling a rate of flow of hot ash through each standpipe; and ash removal means connected at the cooling trough of each ash hopper for draining cooled ash from each ash hopper.

2. The system according to claim 1, wherein each of the standpipes is substantially vertical, and each of the ash hoppers has substantially vertical side walls.

3. The system according to claim 1, wherein at least four standpipes of the plurality of standpipes extend into each of the ash hoppers.

4. The system according to claim 1, wherein the ash removal means comprises a drain connected to the cooling trough of each of the ash hoppers, and an air supply means provided at each cooling trough for motivating cooled ash toward the drain.

5. The system according to claim 4, wherein the ash removal means further comprises an "L" valve connected to each drain, a lockhopper connected to the "L" valve for holding cooled ash, and ash disposal means connected to the lockhopper for removing and disposing of the cooled ash.

6. The system according to claim 1, further comprising cooling coils positioned in the cooling trough inbetween said plurality of standpipes to provide for additional cooling of the hot ash.

7. An ash cooling and removal system for a fluidized bed boiler, the system comprising:

a boiler tube panel floor;

a boiler bed region above the boiler tube panel floor for containing a hot ash;

a plurality of bubble caps projecting above the boiler tube panel floor for providing a fluidizing air to the boiler bed region;

a windbox beneath the boiler tube panel floor;

at least one ash hopper beneath the windbox, each ash hopper having substantially vertical side walls and a cooling trough at a lower end of the at least one ash hopper;

a plurality of substantially vertical standpipes for transporting hot ash from the boiler bed region to one of the at least one ash hoppers, each standpipe extending from above the boiler tube panel floor through the windbox and into one of the at least one ash hoppers, each standpipe having a lower end positioned above the cooling trough, at least four standpipes of said plurality extending into each of the at least one ash hoppers;

fluidizing means at each cooling trough for controlling a rate of flow of hot ash through each standpipe; and ash removal means for removing cooled ash from the at least one ash hopper including at least one drain connected to the cooling trough of each of the at least one ash hoppers, air supply means provided at each cooling trough for motivating cooled ash toward the at least one drain, at least one "L" valve connected to the at least one drain, a lockhopper connected to the at least one "L" valve, and ash disposal means connected to the lockhopper for removing and disposing of the cooled ash.

* * * * *